United States Patent [19]

Bornhorst

[11] Patent Number: 4,709,311

[45] Date of Patent: Nov. 24, 1987

[54] LENS CARRIER

[75] Inventor: James M. Bornhorst, Duncanville, Tex.

[73] Assignee: Vari-Lite, Inc., Dallas, Tex.

[21] Appl. No.: 887,372

[22] Filed: Jul. 16, 1986

[51] Int. Cl.[4] ..... F21V 17/02

[52] U.S. Cl. ..... 362/277; 350/255; 362/280; 362/319; 362/449

[58] Field of Search ..... 362/277, 280, 319, 449; 350/255

[56] References Cited

U.S. PATENT DOCUMENTS

| | | | |
|---|---|---|---|
| 1,042,716 | 10/1912 | Myers | 362/277 |
| 1,695,556 | 12/1928 | McGunnigle . | |
| 2,006,125 | 6/1935 | Barber | 240/41.3 |
| 2,026,156 | 12/1935 | Alexander et al. | 240/41.15 |
| 2,038,514 | 4/1936 | Hummert | 240/41.15 |
| 2,076,240 | 4/1937 | Levy | 240/3 |
| 2,098,990 | 11/1937 | Newton | 128/396 |
| 2,692,329 | 10/1954 | Carter | 240/8.16 |
| 3,060,797 | 10/1962 | Andreas | 350/255 |
| 3,088,370 | 5/1963 | Erbe | 350/255 |
| 3,178,996 | 4/1965 | Anton | 88/24 |
| 4,462,067 | 7/1984 | Altman | 362/268 |
| 4,516,190 | 5/1985 | Kloots | 362/32 |
| 4,519,020 | 5/1985 | Little | 362/268 |

OTHER PUBLICATIONS

Bak, David J., East Coast Editor, "Tube-Within-A-Tube Constitutes Cylinder Slide," *Design News*, 7-21-86, pp. 94-95.

*Primary Examiner*—Douglas Hart

*Attorney, Agent, or Firm*—Richards, Harris, Medlock & Andrews

[57] ABSTRACT

A lens carrier (10) is disclosed for use in a stage lamp. The lens carrier (10) supports a lens (26) in alignment with the lamp axis (12) while permitting limited movement of the lens along the lamp axis to focus the lamp toward the light. First and second members, (14, 22) define facing cylindrical surfaces (20, 24). A bearing assembly (28) having resilient deformable ball bearings (34) is positioned between the cylindrical surfaces to maintain alignment of the lens on the lamp axis and permit the second member and lens to move along the lamp axis relative to the first member while maintaining the alignment.

6 Claims, 2 Drawing Figures

LENS CARRIER

TECHNICAL FIELD

This invention relates to mounting a lens in an optical device, and more particularly to adjustably mounting a lens in a stage light.

BACKGROUND ART

In a modern stage light, it is often desirable to mount an optical lens for limited movement within the light to vary the nature of the light beam emanating from the light. For example, use of a gobo silhouette within the light requires movement of the optical lens to focus the silhouette pattern on the backdrop at the stage.

In designing a lens carrier to carry a lens for movement within the light, several factors are critical. First, the lens must be maintained in the proper orientation in the light path to avoid distortion. The lens carrier must be compact enough to fit within the light, which in itself may contain a large number of components to perform various functions while minimizing the exterior dimensions of the light. Finally, cost effectiveness is of critical concern. A need therefore exists for a light carrier which is capable of satisfying these requirements.

SUMMARY OF THE INVENTION

In accordance with one aspect of the present invention, a lens carrier for supporting a lens in a lamp structure in alignment with a lamp axis is provided. The lens carrier also guides the lens for limited movement along the lamp axis while maintaining alignment. The lens carrier includes a first member secured to the lamp structure and defining a cylindrical exterior surface centered on the lamp axis, said exterior surface formed at a first radius from the lamp axis. The second member defines a cylindrical inner surface at a second radius, the lens is mounted on the second member with the optical axis of the lens coincident with the center line of the cylindrical inner surface. A bearing assembly is provided which has first and second bearing rings positioned between the cylindrical surfaces of the first and second members with the bearing rings being spaced apart along the length of the surfaces to support the lens in alignment with the lamp axis and guide the second member and lens for limited movement along the lamp axis.

In accordance with another aspect of the present invention, each bearing ring has a plurality of ball bearings disposed between the cylindrical surfaces. The ball bearings can be resiliently deformable and have a diameter slightly greater than the difference between the second and first radii so that the ball bearings are slightly compressed between the cylindrical surfaces, removing radial play. The first and second bearing rings can be formed as an integral unit.

BRIEF DESCRIPTION OF THE DRAWINGS

A more complete understanding of the invention can be had by referring to the following Detailed Description taken with the accompanying Drawings, wherein.

DETAILED DESCRIPTION

Figure 1:
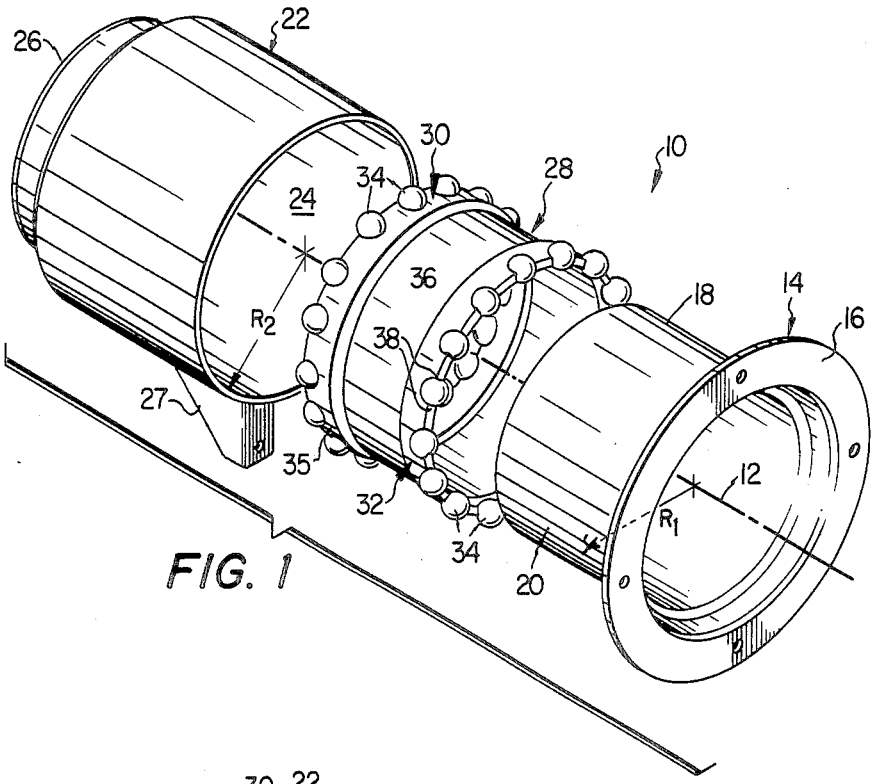
FIG. 1 is an exploded view of the lens carrier illustrating the cooperation of the elements therein.

Referring now to the drawings, wherein like reference numerals designate like or corresponding parts throughout the several views, there is illustrated a lens carrier 10 forming a first embodiment of the present invention. The lens carrier forms part of a stage light such as disclosed in copending patent application Ser. No. 887,371, filed 7/16/86 which disclosure is hereby incorporated by reference. A linear actuator, such as that shown in the referenced patent application, is used to control movement of the lens along the lamp axis 12.

The lens carrier 10 includes a first member 14 which is secured to the structure of the lamp at a rim 16. The first member 14 also defines a cylindrical portion 18 defining an exterior cylindrical surface 20 which is centered on a lamp axis 12 at a first radius, $R_1$, from the lamp axis 12.

A second member 22 is provided which has a generally cylindrical shape defining a cylindrical interior surface 24. The cylindrical interior surface 24 is defined about a center axis at a radius $R_2$. A lens 26 is mounted at one end of the second member 22 with the optical axis of the lens coincident with the center line of the cylindrical interior surface 24. A bracket 27 is mounted on the exterior of second member 22 for receiving one end of a linear actuator (not shown) acting between the lamp structure and second member 22 to move the lens 26 back and forth along axis 12.

A bearing assembly 28 supports the second member 22 and lens 26 on the first member 14 with the optical axis of the lens coincident with the lamp axis 12 and permits this alignment to be maintained as the linear actuator acting between the lamp structure and the bracket 27 moves the second member and the lens along the lamp axis 12.

The bearing assembly 28 has a first ball retaining ring 30 and second ball retaining ring 32 which are spaced from each other along the length of the lamp axis 12. Each of the rings 30 and 32 has a plurality of ball bearings 34 mounted about the circumference of supports 35. The ball bearings roll along the cylindrical surfaces 20 and 24 when the second member 22 is moved relative to the first member 14.

Figure 2:
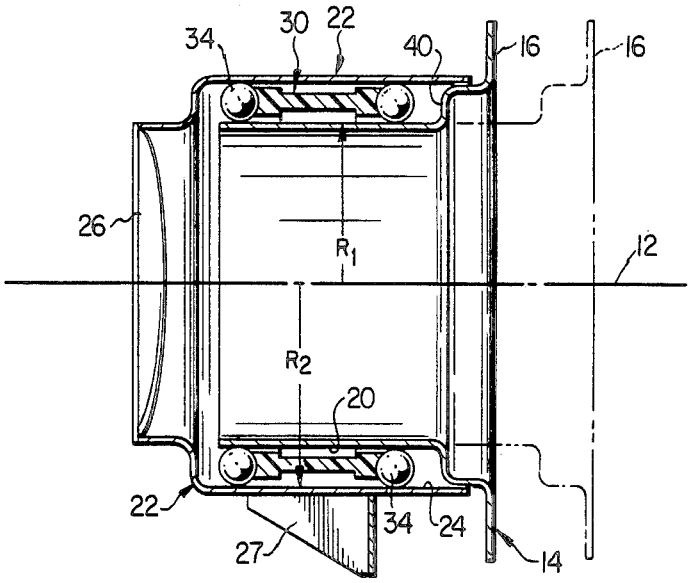
FIG. 2 is a cross sectional side view of the lens carrier.

In the preferred embodiment, the first and second ball retaining rings 30 and 32 are combined into an integral structure with a cylindrical interconnecting member 36 as shown in FIGS. 1 and 2. However, the rings can be separate, so long as sufficient distance exists between the rings to ensure a proper alignment of the lens relative to lamp axis 12 during the entire range of motion of the lens along the lamp axis.

In the preferred embodiment, the individual ball bearings 34 are formed of a resilient deformable material and have a diameter slightly greater than the difference betwen radius $R_2$ and $R_1$. Thus, when the ball bearings are positioned between the cylindrical surfaces 20 and 24, the ball bearings are slightly deformed to insure intimate contact between the cylindrical surfaces and the bearings to provide an accurate alignment of the lens on the lamp axis. For example, the ball bearings can be formed of nylon with a diameter about 0.002 inches larger than the difference between the radius $R_2$ and $R_1$ to provide the proper resilient deformation.

In a preferred embodiment, the bearings supports 35 and intermediate member 36 are also formed of a resilient material. In particular, each of the bearing supports 35 defines cooperating pairs of resilient bearing hooks 38 which surround each of the ball bearings 34 and hold them in place on the rings.

As best seen in FIG. 2, the first member can have an inwardly directed annular surface 40 which acts as a stop for movement of the bearing assembly 28 in the direction toward rim 16. If desired, stops can be positioned between the members to positively limit the motion between the first and second members. However, the linear actuator acting through the bracket 27 will commonly define the range of movement of the second member and lens relative to the first member by the limits of the actuator movement.

While one embodiment of the invention has been illustrated in the accompanying drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. A lens carrier for supporting a lens on a lamp structure in alignment with a lamp axis and for guiding the lens for limited movement along the lamp axis while maintaining alignment, comprising:

a first member secured to the lamp structure and defining a cylindrical exterior surface centered on the lamp axis, said exterior surface being defined at a first radius from the lamp axis;

a second member defining a cylindrical interior surface defined about a center line at a second radius, the lens being mounted on the second member with the optical axis of the lens coincident with the center line of the cylindrical interior surface; and a bearing assembly having first and second ball retaining rings positioned between the cylindrical surfaces of the first and second members, the ball retaining rings being spaced apart along the length of the surfaces to align the lens with the lamp axis and guide the lens and second member for limited movement along the lamp axis relative to the first member while maintaining alignment;

each of said ball retaining rings having a plurality of ball bearings positioned between the cylindrical surfaces of the first and second members and distributed uniformly about the circumference of the cylindrical surfaces; and each of said ball bearings being resiliently deformable and having a diameter slightly greater than the difference between the second and first radii to cause resilient deformation of the ball bearings between the cylindrical surfaces of the first and second members to maintain alignment of the lens with the lamp axis for limited movement along the lamp aixs.

2. The lens carrier of claim 1 wherein said first and second ball retaining rings are formed as an integral unit.

3. The lens carrier of claim 1 wherein each of said first and second ball retaining rings includes resilient ball bearing retaining structure for holding the ball bearings.

4. A lens carrier for supporting a lens on a lamp structure in alignment with a lamp axis and for guiding the lens for limited movement along the lamp axis while maintaining alignment, comprising:

a first member secured to the lamp structure and defining a cylindrical exterior surface centered on the lamp axis, said exterior surface defined at a first radius from the lamp axis;

a second member defining a cylindrical interior surface having a second radius about a center line, the lens being mounted on the second member with the optical axis of the lens coincident with the center line of the cylindrical inner surface, said second radius being larger than the first radius; and a bearing assembly having a first plurality of ball bearings positioned between the cylindrical surfaces of said first and second members and a second plurality of ball bearings spaced along the lamp axis from the first plurality of ball bearings and also positioned between the cylindrical surfaces of the first and second members, sufficient first and second ball bearings being provided about the circumference of the cylindrical surfaces to support the second member on the first member, said first and second plurality of ball bearings rolling along the cylindrical surfaces as the second member is moved relative to the first member, each of said ball bearings being formed of a resilient deformable material and having a diameter sufficiently greater than the difference between the second and first radii to ensure resilient deformation of the ball bearings between the cylindrical surfaces to maintain alignment of the lens and second member along the lamp axis.

5. The lens carrier of claim 4 wherein said ball bearings are formed of nylon.

6. The lens carrier of claim 4 wherein said second member further has a bracket for attachment to a linear actuator to move the second member and lens along the lamp axis relative to the first member.

* * * * *